US012152284B2

(12) United States Patent
Masek et al.

(10) Patent No.: US 12,152,284 B2
(45) Date of Patent: Nov. 26, 2024

(54) METHOD OF THERMOMECHANICAL TREATMENT OF SEMI-FINISHED PRODUCTS OF HIGH-ALLOY STEEL

(71) Applicant: Zapadoceska univerzita v Plzni, Plzen (CZ)

(72) Inventors: Bohuslav Masek, Kaznejov (CZ); Ctibor Stadler, Plzen (CZ)

(73) Assignee: Zapadoceska univerzita v Plzni, Plzen (CZ)

( * ) Notice: Subject to any disclaimer, the term of this patent is extended or adjusted under 35 U.S.C. 154(b) by 32 days.

(21) Appl. No.: 16/802,193

(22) Filed: Feb. 26, 2020

(65) Prior Publication Data

US 2021/0047703 A1 Feb. 18, 2021

(30) Foreign Application Priority Data

Aug. 16, 2019 (CZ) ..... PV 2019-537

(51) Int. Cl.

| | |
|---|---|
| ***C21D 1/18*** | (2006.01) |
| ***C21D 6/00*** | (2006.01) |
| ***C21D 8/00*** | (2006.01) |
| ***C22C 38/18*** | (2006.01) |
| ***C22C 38/22*** | (2006.01) |
| ***C22C 38/24*** | (2006.01) |

(52) U.S. Cl.

CPC ..... *C21D 1/18* (2013.01); *C21D 6/00* (2013.01); *C21D 8/005* (2013.01); *C22C 38/18* (2013.01); *C22C 38/22* (2013.01); *C22C 38/24* (2013.01)

(58) Field of Classification Search

None

See application file for complete search history.

(56) References Cited

U.S. PATENT DOCUMENTS 2,576,782 A * 11/1951 Daley ..... B21B 27/00 148/278
3,752,709 A * 8/1973 Zackay et al. ..... C22C 38/40 148/609
10,378,075 B2 8/2019 Valdez et al.

FOREIGN PATENT DOCUMENTS

CN 101515743 A * 8/2009
CN 105154788 A * 12/2015
CN 110202109 A * 9/2019 ..... B22D 17/007
DE 1508416 * 6/1976 ..... C22C 38/00
DE 102005013651 A1 * 12/2005 ..... B21J 5/00
JP 10306315 A * 11/1998
RU 2405840 C1 * 12/2010

OTHER PUBLICATIONS

Jirkova et al. "Semi-solid processing of high-chromium tool steel to obtain microstructures without carbide network" 4th International Conference Recent Trends in Structural Materials. IOP Conf. Series: Materials Science and Engineering 179 (2017) 012036. (Year: 2017).*
Hana Jirkova et al. "Effect of the Parameters of Semi-Solid Processing on the Elimination of Sharp-Edged Primary Chromium Carbides from Tool Steel." Metals. 2018, 8, 713. (Year: 2018).*
Aisman et al. "The influence of deformation and cooling parameters after transition through semi-solid state on structure development of ledeburite steel" Journal of Alloys and Compounds 536A (2012) S204-S207. (Year: 2012).*
David Aisman et al. "Unconventional Microstructures in Tool Steel Obtained by Semi-Solid Processing and Subsequent Heat Treatment" Solid State Phenomena vols. 217-218, pp. 235-240. Online Sep. 19, 2014. (Year: 2014).*
(Masek et al. "Microstructure of tool steel upon combined semi-solid processing and thermomechanical treatment" Journal of Alloys and Compounds 586 (2014) S165-S167. Available online Mar. 14, 2013. (Year: 2013).*
RU 2405840 machine translation (Year: 2010).*
CN 105154788 machine translation (Year: 2015).*
Plaza et al. Thixoforming of high carbon ferrous alloys: metallographic features. Microstructural Science vol. 24, Jul. 21-24, 1996, Pittsburgh, PA. 133-136. (Year: 1996).*
DD 242058 STN abstract (Year: 1987).*
JP H10-306315 machine translation (Year: 1998).*
DD 242058 machine translation (Year: 1985).*
DE 1508416 machine translation (Year: 1976).*
Zhang et al. Effect of Heat Treatment and Hot Deformation on Carbide in High Speed Steel M2 Cast-Strip. Special Steel (Teshugang), 2006, 27(6): 18-20. (Year: 2006).*
DE 102005013651 machine translation (Year: 2005).*
Rubesova et al. Innovative process to eliminate ledeburite network in tool steel. Manufacturing Technology. Dec. 2017, vol. 17, No. 6. Abstract. (Year: 2017).*
CN 110202109 machine translation (Year: 2019).*
CN 101515743 machine translation (Year: 2009).*

* cited by examiner

*Primary Examiner* — Paul A Wartalowicz
*Assistant Examiner* — Stephani Hill
(74) *Attorney, Agent, or Firm* — Brett A. Schenck

(57) ABSTRACT

This invention generally relates to a method for the thermomechanical treatment of semi-finished products of high-alloy steel. Typically, the method involves initially heating the steel semi-finished product to at least 1200° C., after which the semi-finished product is cooled and then reheated to a forming temperature, at which the semi-finished product is formed. Afterwards, the formed product is then cooled to ambient temperature.

7 Claims, No Drawings

METHOD OF THERMOMECHANICAL TREATMENT OF SEMI-FINISHED PRODUCTS OF HIGH-ALLOY STEEL

RELATED APPLICATIONS

This application claims the foreign priority benefit of Czech Patent Application Serial No. PV 2019-537 entitled "METHOD OF THERMOMECHANICAL TREATMENT OF SEMI-FINISHED PRODUCTS OF HIGH-ALLOY STEEL," filed Aug. 16, 2019, the entire disclosure of which is incorporated herein by reference.

FIELD OF INVENTION

This invention generally relates to a method for the thermomechanical treatment of semi-finished products of high-alloy steel.

BACKGROUND ART

When produced by conventional metallurgy, high-alloy tool steels contain large sharp-edged $M_7C_3$ carbides, which remain stable even at high temperatures. There is substantially no way of converting these carbides by means of conventional heat treatment to a more favourable morphology, i.e., to finer and more uniformly dispersed carbides. Since large sharp-edged primary carbides considerably reduce toughness, this kind of steel must be produced by powder metallurgy, which can obviate the risk of formation of large chromium carbides. A method of removing carbides is described in U.S. Pat. No. 10,378,075.

SUMMARY

One or more embodiments of the present invention generally concern a method for the thermomechanical treatment of semi-finished products of high-alloy steel. Generally, the method comprises: (a) heating a semi-finished steel product to a temperature of at least 1200° C. to form a heated product; (b) cooling the heated product to form a first cooled product; (c) reheating the first cooled product to a forming temperature to thereby produce a formed product; and (d) cooling the formed product to ambient temperature.

DETAILED DESCRIPTION

The invention generally relates to a method for the thermomechanical treatment of semi-finished products of high-alloy steel, in which the steel semi-finished product is heated above 1200° C., after which the semi-finished product is cooled and then reheated to a forming temperature, at which the semi-finished product is formed and then cooled to ambient temperature. Chromium carbides only dissolve at temperatures above the solidus. Therefore, a technique based on semi-solid-processing may be used for removing these carbides from high-alloy tool steels. During semi-solid processing, the material exists as a mixture of liquid and solid phases. When in the semi-solid state, the material exhibits thixotropy and can be shaped by thixoforming.

Thixoforming is a technique which can be used to produce intricate-shape parts in a single forming cycle. It creates microstructures characterized by polyhedral grains of super-saturated austenite embedded in a carbide network. The network consists of lamellar carbides and austenite. Consequently, no large sharp-edged primary carbides remain in the structure. In such structures, austenite possesses an extraordinary thermal stability. Its thermal decomposition only starts at a temperature as high as 500° C. The decomposition is complete during annealing at 550 to 600° C. Austenite per se is ductile, but the carbide network lacks the ability to undergo sufficient plastic deformation at room temperature (RT). Nevertheless, materials with these structures can be formed successfully by compressive deformation. It has been verified experimentally that they can also be formed at high temperatures between 1000° C. and the solidus.

At an appropriate temperature, the carbide network can be broken up by forming at an appropriate magnitude and intensity of deformation, and carbides can be dispersed uniformly throughout the austenitic matrix. After cooling, these carbides can remain dispersed, and therefore contribute to the strength of the resulting structure. These carbides may retard austenite grain growth in the course of deformation at high temperatures. Deformation and temperature can cause these carbides to partially dissolve. After reprecipitation, the carbides can contribute to additional strengthening of the matrix. To achieve optimal properties, the matrix can be altered by additional heat treatment, such as quenching and tempering, or even quenching and partitioning. If mechanical working finishes under appropriate conditions, a structure with fine martensite is obtained.

An unconventional thermomechanical treatment route was used to remove large sharp-edged primary chromium carbides from tool steels, in which these carbides normally form during solidification at the metallurgical stage of production and are impossible to remove by classical heat treatment. The underlying principle is to use conversion to the semi-solid state to transform the initial microstructure to polyhedral austenite embedded in a carbide-austenite network, and then use forming to break up this network and produce a fine microstructure of a martensitic-austenitic constituent and fine chromium carbide precipitates. The semi-solid condition is necessary to achieve a temperature at which primary sharp-edged chromium carbides dissolve. By this means, the carbides can be converted to an austenitic-carbidic structure, which can be hot-formed, and, using plastic deformation, the carbide network can be fragmented, and the carbides dispersed uniformly.

One or more embodiments concern a method for the thermomechanical treatment of semi-finished products of high-alloy steel. In various embodiments, the method comprises: (a) heating a semi-finished steel product to a temperature of at least 1200° C. to form a heated product; (b) cooling the heated product to form a first cooled product; (c) reheating the first cooled product to a forming temperature to thereby produce a formed product; and (d) cooling the formed product to ambient temperature. During the heating of step (a), the semi-finished steel product may be held at 1200° C. for at least 15 minutes. Furthermore, in various embodiments, the semi-finished steel product is cooled to a temperature between 20° C. and 1100° C. during the cooling of step (b). Moreover, in various embodiments, the forming temperature of the semi-finished steel product is between 1050° C. and 1100° C. and the semi-finished steel product may be held at this temperature for at least 1.5 minutes.

The invention can be used in metallurgical processing and in the manufacture of parts, primarily for the machinery industry.

This invention can be further illustrated by the following examples of embodiments thereof, although it will be understood that these examples are included merely for the purposes of illustration and are not intended to limit the scope of the invention unless otherwise specifically indicated.

EXAMPLES

Example 1

X210Cr12 is a high-carbon and high-chromium steel that contains the composition shown in TABLE 1. X210Cr12 was developed for applications in punching and pressing tools, mainly for heavy-duty punches and highly-complex progressive and combination tools. It is a suitable material for blades for shearing wires, sheet, and other stock. Its initial annealed microstructure contains large sharp-edged primary chromium carbides and very fine cementite embedded in a ferritic matrix. In order to find the appropriate process parameters, it was necessary to identify the freezing range and the dissolution temperature of the chromium carbides.

It was found that the material retains a stable ferrite-cementite microstructure up to 758° C. The material begins to melt at 1225° C. and becomes fully melted at 1373° C. The liquid fraction vs. temperature curve shows that primary chromium carbides dissolve at 1255° C.

TABLE 1

Chemical composition of the material X210Cr12 (wt. %)

| C | Cr | Mn | Si | Ni | P | S |
|---|---|---|---|---|---|---|
| 1.8 | 11 | 0.2 | 0.2 | 0.5 | 0.03 | 0.035 |

To obtain carbide precipitates with an optimal distribution, sizes, and morphology, and microstructures with optimal austenite grain sizes and martensite volume fractions, a number of treatment parameters had to be optimized, starting with the temperature of heating to semi-solid state. To break up the lamellar network and initiate recrystallization, the material had to be worked using a large amount of deformation. Open-die forging in a hydraulic press was used. As the material was heated to semi-solid state, the semi-finished product was enclosed in a container made of low-carbon steel. This simplified the handling of the partially melted material and made the temperature field more homogeneous. A container with a diameter of 30 mm, wall thickness of 6 mm, and length of 55 mm was made of SJ355 low-carbon steel, whose melting temperature was above 1400° C. The semi-finished products were heated in a furnace with no protective atmosphere. Flat dies were used for forming. Several different treatment routes were tested, as shown in TABLE 2.

Routes 1-3 involved a heating temperature of 1265° C. and a heating time of 15 minutes. At this temperature, all primary chromium carbides were dissolved, and the structure comprised a liquid phase and austenite. According to calculations, the liquid fraction was 30%. The variants included quenching in water to 500° C. (routes 1 and 2) and to room temperature (route 3), followed by reheating to the forming temperature, either at 1050° C. or 1110° C., and holding for 5 minutes. The semi-finished products were upset to a half height in a single operation.

In the next route, the heating temperature was reduced to 1220° C. This temperature was just below the calculated solidus temperature. At this temperature, the microstructure still contained about 8% of M7C3 carbides. In route 4, quenching to 600° C. was performed and followed by reheating in a furnace to a forming temperature of 1050° C. The semi-finished product was first upset to a half height, then drawn out to 50 mm and then upset again to a height of 20 mm.

Another variant (route 5) had the same heating temperature, but involved cooling to no less than 1100° C. followed by forming: upsetting—drawing-out—upsetting—drawing-out. Forming was finished at a temperature below 800° C.

In order to explore the effects of the holding time, route 6 had the holding time extended to 60 minutes. The purpose was to ascertain whether the austenite grains coarsen, whether coarser grains affect the morphology of recrystallized grains after forming, and whether a larger proportion of primary chromium carbides dissolve.

In yet another variant (route 7), the heating temperature was reduced further, to 1200° C. At this temperature, there should be no liquid phase in the structure, and therefore comparison could be made between the effects of different liquid fractions on microstructural evolution. Upon heating, the microstructure comprised a mixture of austenite and 9% of carbides. The heating temperature and times were 1240° C. and 15 minutes and 60 minutes, respectively. This temperature was close to the temperature of complete dissolution of primary chromium carbides. Nevertheless, their amount is still approximately 7% in the structure. Cooling to 900° C. was performed, followed by reheating to the forming temperature of 1080° C.

In order to characterize the effect of higher liquid fraction on microstructural evolution, route 10 involved the highest heating temperature, 1280° C. It was expected to lead to complete dissolution of carbides and to melting of austenite.

TABLE 2

Parameters of thermomechanical treatment of X210Cr12 steel

| Procedure | Temperature of heating [° C.] | Time at temperature [min] | Temperature of cooling [° C.] | Temperature of reheating [° C.] | Time at temperature [min] | Number of forming steps [—] | HV10 [—] |
|---|---|---|---|---|---|---|---|
| 1 | 1265 | 15 | 500 | 1050 | 5 | 1 | 520 |
| 2 | 1265 | 15 | 500 | 1100 | 5 | 1 | 487 |
| 3 | 1265 | 15 | RT | 1050 | 12 | 1 | 520 |
| 4 | 1220 | 15 | 600 | 1050 | 6 | 3 | 788 |
| 5 | 1220 | 15 | 1100 | — | — | 4 | 803 |
| 6 | 1225 | 60 | 900 | 1080 | 1.5 | 5 | 836 |
| 7 | 1200 | 15 | 1000 | 1070 | 2 | 4 | 848 |
| 8 | 1240 | 15 | 900 | 1080 | 1.5 | 5 | 864 |
| 9 | 1240 | 60 | 900 | 1080 | 1.5 | 5 | 855 |
| 10 | 1280 | 16 | 900 | 1080 | 1.5 | 5 | 866 |

Example 2

X155CrVMol21 is a chromium-molybdenum-vanadium hypereutectoid cold-work tool steel, which contains the composition depicted in TABLE 3. It can be oil-quenched or air-quenched and offers excellent hardenability, better than X210Cr12 steel. Generally, X155CrVMol21 has high wear resistance and sustains high compressive loads. It is also used for blanking tools operating under severe loads, up to a thickness of approximately 10 mm, and for trimming tools for forged parts, as well as for punching, drawing and extrusion tools. Other applications for X155CrVMol21 include hot-forming tools, where high hardness and wear resistance are required, and cutting tools for machining low-strength metals.

TABLE 3

Chemical composition of the material X155CrVMo121 (wt. %)

| C | Cr | Mn | Si | Mo | V | P | S |
|---|---|---|---|---|---|---|---|
| 1.5 | 11 | 0.3 | 0.3 | 0.6 | 0.9 | 0.03 | 0.035 |

TABLE 4

Parameters of thermomechanical treatment of X155CrVMo121 steel

| Procedure | Temperature of heating [° C.] | Time at temperature [min] | Temperature of cooling [° C.] | Temperature of reheating [° C.] | Time at temperature [min] | HV10 [—] |
|---|---|---|---|---|---|---|
| 1 | 1265 | 15 | — | — | — | 376 |
| 2 | 1300 | 15 | — | — | — | 379 |
| 3 | 1265 | 15 | 930 | 1080 | 1.5 | 359 |
| 4 | 1300 | 15 | 950 | 1080 | 1.5 | 375 |

The semi-finished product was enclosed in a container from SJ355 low-carbon steel, whose melting temperature is above 1400° C. Due to this arrangement, it was possible to handle the partially-melted material between furnaces. Four different treatment routes were carried out, as shown in TABLE 4. First, two different heating temperatures, 1265° C. and 1300° C., were tested, with time at temperature in the furnace of 15 minutes. At 1265° C., the material contained approximately 20% liquid phase and at 1300° C. it contained approximately 31% liquid phase. After holding at temperature, quenching in water to room temperature was performed. In route 3, heating at 1265° C. was followed by quenching in water for 2 seconds. Using a pyrometer, the temperature of the specimen was found to be 930-950° C. Then, reheating to 1080° C. and holding for 1.5 minutes was carried out. At this temperature, the material began to enter the austenite region again. After holding for 1.5 minutes, the specimen was quenched in water. This holding time represents the time period in which forging in a hydraulic press is performed in subsequent routes.

Definitions

It should be understood that the following is not intended to be an exclusive list of defined terms. Other definitions may be provided in the foregoing description, such as, for example, when accompanying the use of a defined term in context.

As used herein, the terms "a," "an," and "the" mean one or more.

As used herein, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination, B and C in combination; or A, B, and C in combination.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "having," "has," and "have" have the same open-ended meaning as "comprising," "comprises," and "comprise" provided above.

As used herein, the terms "including," "include," and "included" have the same open-ended meaning as "comprising," "comprises," and "comprise" provided above.

Numerical Ranges

The present description uses numerical ranges to quantify certain parameters relating to the invention. It should be understood that when numerical ranges are provided, such ranges are to be construed as providing literal support for claim limitations that only recite the lower value of the range as well as claim limitations that only recite the upper value of the range. For example, a disclosed numerical range of 10 to 100 provides literal support for a claim reciting "greater than 10" (with no upper bounds) and a claim reciting "less than 100" (with no lower bounds).

CLAIMS NOT LIMITED TO DISCLOSED EMBODIMENTS

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

What is claimed is:

1. A method for thermomechanical treatment of semi-finished products of high-alloy steel, the method comprising:

(a) heating a semi-finished steel product to a temperature of at least 1200° ° C. for at least 15 minutes to form a heated product;

(b) cooling the heated product in water to a temperature in the range of 930° ° C. to 950° C. to form a first cooled product;

(c) forming the first cooled product at a forming temperature for at least 1.5 minutes to thereby produce a formed product comprising carbides uniformly dispersed in an austenitic matrix, wherein the forming temperature is between 1050° C. and 1100° C.; and (d) cooling the formed product to ambient temperature.

2. The method according to claim 1, wherein the cooled formed product has a Vickers Hardness (HV) of 359 to 379 at a load of 10 kg.

3. The method according to claim 1, wherein the semi-finished steel product is X155CrVMo121 steel.

4. The method according to claim 1, wherein the cooling of step (d) comprises quenching the formed product in water.

5. A method for thermomechanical treatment of semi-finished products of high-alloy steel, the method consisting of:

(a) heating a semi-finished steel product to a temperature of at least 1200° ° C. for at least 15 minutes to form a heated product;

(b) quenching the heated product in water to a temperature in the range of 930° C. to 950° C. to form a first cooled product;

(c) forming the first cooled product at a forming temperature for at least 1.5 minutes to thereby produce a formed product comprising carbides uniformly dispersed in an austenitic matrix, wherein the forming temperature is between 1050° ° C. and 1100° C.; and (d) cooling the formed product in additional water to ambient temperature.

6. The method according to claim 5, wherein the cooled formed product has a Vickers Hardness (HV) of 359 to 379 at a load of 10 kg.

7. The method according to claim 5, wherein the semi-finished steel product is X155CrVMo121 steel.

* * * * *